United States Patent [19]

Malagari, Jr.

[11] Patent Number: 4,608,100

[45] Date of Patent: Aug. 26, 1986

[54] METHOD OF PRODUCING THIN GAUGE ORIENTED SILICON STEEL

[75] Inventor: Frank A. Malagari, Jr., Freeport, Pa.

[73] Assignee: Allegheny Ludlum Steel Corporation, Pittsburgh, Pa.

[21] Appl. No.: 553,731

[22] Filed: Nov. 21, 1983

[51] Int. Cl.[4] ..... H01F 1/04

[52] U.S. Cl. ..... 148/111; 148/112

[58] Field of Search ..... 148/111, 112

[56] References Cited

U.S. PATENT DOCUMENTS

| | | | |
|---|---|---|---|
| 3,165,428 | 1/1965 | Albert et al. | 148/111 |
| 3,271,202 | 9/1966 | Freeman et al. | 148/112 |
| 3,345,219 | 10/1967 | Detert | 148/112 |
| 3,586,545 | 6/1971 | Stanley | 148/111 |
| 3,632,456 | 1/1972 | Sakatura et al. | 148/111 |
| 4,251,295 | 2/1981 | Foster et al. | 148/111 |
| 4,251,296 | 2/1981 | Thornburg et al. | 148/111 |
| 4,291,558 | 9/1981 | Santoli et al. | 72/38 |
| 4,469,533 | 9/1984 | Inokuti et al. | 148/111 |

*Primary Examiner*—John P. Sheehan

*Attorney, Agent, or Firm*—Patrick J. Viccaro

[57] ABSTRACT

A method is provided for producing thin gauge cube-on-edge grain-oriented silicon steel from hot-rolled band to final gauge in two cold reduction steps. The two-stage cold reduction process requires an intermediate anneal between the two stages of cold reduction and requires that the cold working of the desired intermediate gauge to final gauge include a cold reduction of at least 55% to provide a final gauge product of nominally 0.007 inch.

A cube-on-edge grain-oriented silicon steel product is also provided.

6 Claims, 1 Drawing Figure

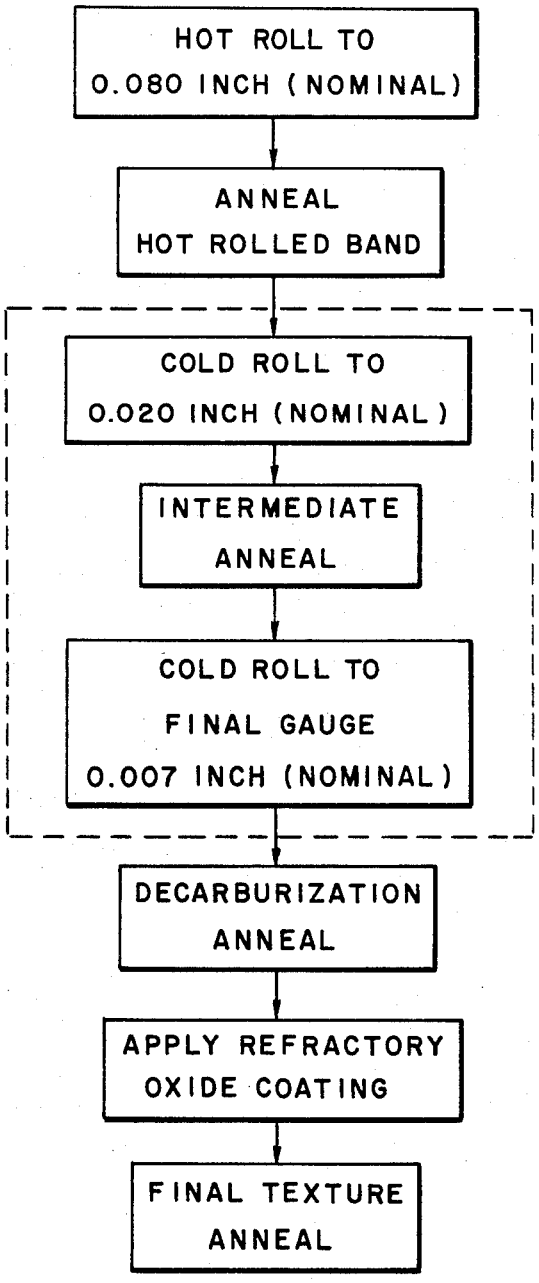
HOT ROLL TO
0.080 INCH (NOMINAL)
ANNEAL
HOT ROLLED BAND
COLD ROLL TO
0.020 INCH (NOMINAL)
INTERMEDIATE
ANNEAL
COLD ROLL TO
FINAL GAUGE
0.007 INCH (NOMINAL)
DECARBURIZATION
ANNEAL
APPLY REFRACTORY
OXIDE COATING
FINAL TEXTURE
ANNEAL

METHOD OF PRODUCING THIN GAUGE ORIENTED SILICON STEEL

BACKGROUND OF THE INVENTION

This invention relates to a method of producing thin gauge cube-on-edge oriented silicon-iron sheet using a two-stage cold reduction. More particularly, the invention relates to a more economical method of producing thin gauge, using only two cold-reduction steps to provide a steel having magnetic properties of core loss and magnetic permeability comparable or better than any conventional three-stage process.

In the manufacture of grain-oriented silicon steel, it is known that if improved secondary recrystallization texture is achieved, the magnetic properties, particularly permeability and core loss, will be correspondingly improved. The Gauss texture (110)[001], in accordance with Miller's Indices, refers to the body-centered cubes making up the grains or crystals being oriented in the cube-on-edge position. The texture or grain orientation of this type refers to the cube edges being parallel to the rolling direction and in the plane of rolling, and the cube face diagonals being perpendicular to the rolling direction and in the rolling plane. As is well known, steel having this orientation is characterized by a relatively high permeability in the rolling direction and a relatively low permeability in a direction at right angles thereto.

Grain-oriented silicon steel is useful as cores for distribution and power transformers and generators and, thus, it is important that the steel be characterized by good magnetic permeability and core loss values. It is known that the core loss is made up of two main components, that due to the hysteresis effect, and that due to eddy currents. The magnitude of the eddy currents is also limited by the resistance of the path through which they flow. The resistance of the core material is determined by the resistivity of the material and its thickness or cross-sectional area. Consequently, it is desirable that technically important magnetic materials have a high resistivity and be produced in thin sheets in order that eddy current losses can be kept to a minimum.

In recognition of the advantages of providing a thin gauge silicon-iron sheet, numerous attempts have been made to produce such thin gauge material of less than 0.01 inch (.254 mm) U.S. Pat. No. 3,586,545, issued June 22, 1971, discloses a method of producing cube-on-edge oriented silicon-iron sheet stock 0.005 to 0.010 inch (0.127 to 0.254 mm) thick using a triple cold reduction of the silicon-iron hot band. Each cold reduction is followed by an annealing operation. The method of that patent further requires that the first and third cold reduction be about a 50% thickness reduction.

U.S. Pat. No. 3,632,456, issued Jan. 4, 1972, discloses a process for producing thin gauge electromagnetic steel sheet using a two-stage cold reduction process. The process of that patent, however, requires a specific composition of the steel such that it contains 0.010 to 0.065% acid soluble aluminum and requires the step of annealing the hot-rolled sheet to cause AlN to precipitate in the steel sheet prior to the two cold rolling steps. The final cold rolling is carried out at a reduction rate of 70 to 95% thickness reduction to a final gauge of 0.35 to 0.05 mm (0.014 to 0.002 inch).

Neither of the patents teach or suggest the two-stage cold reduction process of the present invention for producing conventional grain-oriented silicon steel in thin gauges of less than 0.0085 inch (0.216 mm). Though conventional two-stage cold rolling reduction processes are known for producing standard gauge 10–14 mil grain-oriented silicon steel, it is desirable to provide an economical process for producing thin gauge silicon-iron sheet.

What is needed is a process to produce thin gauge conventional grain-oriented silicon steel with comparable or better magnetic properties, particularly core loss and magnetic permeability, than can be available with more conventional three-stage cold rolling processes. The improved process should consistently produce thin gauge silicon-iron sheet having a combination of good magnetic permeability and core loss, such as is suitable for distribution transformers at low frequencies and relatively high inductions. The improved process should also be sufficiently economical to allow production of a thin gauge product which is competitive with commercial thicker gauge products presently on the market. It is also desirable to provide a thin gauge silicon-iron sheet of nominally 7 mils characterized by a core loss of less than 0.720 WPP at 60 Hertz at 17 KG, and a magnetic permeability of at least 1820 ($G/O_e$) at 10 oersteds.

SUMMARY OF THE INVENTION

In accordance with the present invention, a process is provided for producing thin gauge cube-on-edge grain-oriented silicon steel from hot-rolled band to final gauge in two cold reduction steps wherein the method includes cold working the hot-rolled band to an intermediate gauge steel, annealing the intermediate gauge, cold working the annealed intermediate gauge steel to a final gauge less than 0.0085 inch (0.216 mm) by a cold reduction of at least 55%, and final texture annealing for a time and temperature sufficient to develop secondary recrystallization. The cold-worked intermediate gauge ranges from .018 to 0.026 inch (0.46 to 0.66 mm). The method provides that the hot-rolled band is first cold worked to an intermediate gauge to allow a second cold working of at least 55% reduction to final gauge.

A cube-on-edge grain-oriented silicon steel produced by the method of the present invention is also provided.

BRIEF DESCRIPTION OF THE DRAWING

The sole FIGURE is a flow diagram of typical steps of the processes of the present invention.

DETAILED DESCRIPTION OF THE PREFERRED EMBODIMENTS

The process includes an initial cold working of hot-rolled band to an intermediate gauge followed by an intermediate anneal which is followed by a second cold working having at least 55% reduction from intermediate gauge to final gauge. As used herein, cold working refers to all forms of cold reduction, and preferably includes cold rolling. As used herein, each stage or step of cold reduction may include one or more individual rolling passes; however, only each step or stage is separated by intermediate anneals.

Specific processing up to the steps of cold reduction of the steel and including steps through hot-rolled band, may be conventional and are not critical to the present invention. Furthermore, specific processing after cold reduction to final gauge to achieve the desired secondary recrystallization of the cube-on-edge grain orientation may be conventional and are not critical to this invention.

In the manufacture of grain-oriented silicon steel, the typical steps include subjecting the melt of 2.5–4% silicon steel through a casting operation, such as a continuous casting process, hot rolling the steel, cold rolling the steel to final gauge, decarburizing the steel, applying a refractory oxide base coating to the steel, and final texture annealing the steel, such as in a hydrogen atmosphere, to produce the desired secondary recrystallization and purification treatment to remove impurities, such as nitrogen and sulfur.

Although the cold working process of the present invention should have utility with grain-oriented silicon steels generally, the following typical composition is one example of a silicon steel composition which can be processed by the method of the present invention:

| C | Mn | S | Cu | Si | Fe |
|---|---|---|---|---|---|
| 0.030 | 0.070 | 0.025 | .25 | 3.25 | Balance |

As was stated above, specific processing of the steel up through the hot-rolled band stage may be conventional and is not critical to the present invention. Conventionally, the hot-rolled band may have a gauge ranging from 0.06 to 0.10 inch (1.52 to 2.54 mm) Typically, the hot rolled band has a gauge of about 0.08 inch (2.03 mm).

After conventional hot-rolled annealing, the present invention requires a first cold working of the hot-rolled band to an intermediate gauge. The hot-rolled band is first cold worked to a desired intermediate gauge to allow the second cold working of at least 55% reduction from the intermediate gauge to the final gauge. The intermediate gauge may range from 0.018 to 0.026 inch (0.46 to 0.66 mm) and preferably ranges from 0.019 to 0.022 inch (0.48 to 0.56 mm). Typically, the intermediate gauge may be on the order of 20 mils. Furthermore, the amount of cold reduction in the first stage from hot-rolled band to the intermediate gauge is preferably at least 75% and generally ranges from 72 to 76%.

In accordance with the present invention, the intermediate gauge is subjected to an intermediate anneal before further cold reduction. The purpose of such anneal is to relieve internal mechanical stresses of the steel and to effect fine grained primary recrystallized structure. The annealing step may be batch or continuous and generally ranges from temperatures of 1700° to 1800° F. (926° to 982° C.) in a protective nonoxidizing atmosphere, such as nitrogen or hydrogen or mixtures thereof. Preferably, the annealing temperature ranges from 1700° to 1750° F. (926° to 954° C.).

After annealing, the intermediate gauge is subjected to further cold working. This second cold working state appears to be the most important of the cold working process and requires a reduction from intermediate to final gauge of at least 55 and generally up to 76%. Preferably, the final reduction ranges from 55 to 72%, and more preferably from 61 to 71%.

The final gauge material referred to herein is generally considered thin gauge if it is less than 8.5 mils in thickness and preferably ranges from 6 to 8.5 mils. Typically, such thin gauge material may be about 7 mils and as used herein, thin gauge refers to a nominal thickness of 7 mils.

To illustrate the several aspects of the method of the present invention, various samples of a silicon steel having a composition similar to the typical composition were processed and the results of the test are shown in the following Table I.

The starting material consisted of hot-rolled band from the mill of about 0.080 inch (2.03 mm) which was then cold rolled in the laboratory to various intermediate gauges as shown in Table I, then subjected to an intermediate annealing in a nitrogen-hydrogen atmosphere, and then cold rolled to final gauges as shown in Table I. The final gauge material was then decarburization annealed in an atmosphere of a nitrogen-hydrogen mixture, coated with a refractory coating including MgO, and then subjected to a final texture anneal to achieve the secondary recrystallization structure. In a conventional manner, the magnetic properties were measured, including core loss in watts per pound at 60 Hertz at 10, 13, 15 and 17 KG; permeability ($G/O_e$) at 10 oersteds and at 200B.

TABLE I

| Heat | HRB Gauge | Intermediate Gauge | Final Gauge | Avg. % Final Cold Red. | Core Loss (WPP) at 10 KG (1.0 T) | 13 KG (1.3 T) | 15 KG (1.5 T) | 17 KG (1.7 T) | Permeability at 10 H | 200 B |
|---|---|---|---|---|---|---|---|---|---|---|
| 602 | 0.08 | .026 | .0087 | 67 | .190 | .335 | .479 | .773 | 1768 | 12700 |
| | | .022 | .0083 | 62 | .188 | .326 | .463 | .726 | 1819 | 13400 |
| | | .019 | .0085 | 55 | .183 | .316 | .445 | .662 | 1846 | 14800 |
| | | .026 | .0075 | 71 | .181 | .314 | .441 | .676 | 1845 | 12100 |
| | | .022 | .0076 | 65 | .187 | .324 | .445 | .671 | 1852 | 11500 |
| | | .019 | .0076 | 60 | .198 | .340 | .479 | .722 | 1840 | 11100 |
| | | .026 | .0062 | 76 | .179 | .305 | .433 | .676 | 1847 | 11200 |
| | | .022 | .0062 | 72 | .183 | .305 | .437 | .668 | 1847 | 10800 |
| | | .019 | .0062 | 68 | .185 | .310 | .445 | .693 | 1849 | 10800 |
| 485 | 0.08 | .026 | .0085 | 67 | .186 | .328 | .465 | .713 | 1826 | 14600 |
| | | .022 | .0087 | 61 | .191 | .324 | .455 | .670 | 1850 | 15600 |
| | | .019 | .0086 | 55 | .190 | .323 | .458 | .687 | 1837 | 14800 |
| | | .026 | .0075 | 71 | .188 | .326 | .451 | .708 | 1825 | 12800 |
| | | .022 | .0076 | 66 | .191 | .336 | .468 | .722 | 1822 | 12000 |
| | | .019 | .0074 | 61 | .202 | .355 | .508 | .796 | 1799 | 10700 |
| | | .026 | .0063 | 76 | .191 | .327 | .470 | .732 | 1822 | 10900 |
| | | .022 | .0062 | 72 | .188 | .324 | .460 | .726 | 1833 | 11600 |
| | | .019 | .0061 | 68 | .189 | .324 | .459 | .718 | 1835 | 11400 |

The data in Table I show the percent final cold reduction from intermediate gauge to final gauge ranging from as low as 55% to a high of 76%. The data generally show that excellent quality can be generated in material as thin as 0.0062 inch (0.16 mm) using the two-stage cold reduction method of the present invention.

The underlined numbers in Table I indicate for the lowest core losses at 17 KG, the percent final cold reduction for the three final gauges for each Heat.

The data in Table I clearly show the effect of final percent cold work on the magnetic quality of each gauge shown in the Table. More importantly, the data show a relationship between quality, gauge and percent final cold work, i.e., as the final gauge decreases, the percent final reduction increases to achieve the optimum quality. For example, for Heat 602, the lowest loss at 17 KG for nominal 9 mils occurs with a 55% final reduction with increasing losses as the percent final reduction also increases. The nominal 7.5 mils samples show the lowest core loss at 17 KG with 65% final reduction and a higher core loss if the final percent reduction is less than 65% reduction. Thus, this thinner gauge of 7.5 mils requires a higher percent final reduction to achieve a lower core loss at 17 KG. Those skilled in the art are aware that the direction for improved quality is to achieve the lowest core losses-for improved efficiency in devices, such as transformers. Likewise, the data show the nominal 6.2 mils samples to achieve the lowest and best losses at a final percent reduction of 72%. The trend of the data shows the lowest losses for Heat 602 to occur with an increasing percent final cold reduction as the final gauge of the steel decreases.

With each gauge, the percent final reduction also appears to be important and can change from sample to sample as shown by the data for Heat 485. The overall quality for this Heat is not quite as good as for Heat 602, so that the final percent reduction needed to optimize quality for any particular gauge can be different. For example, the nominal 8.5 mils samples produced the lowest loss at 17 KG of 0.670 WPP with a 61% final cold reduction instead of 55% as shown for Heat 602. Likewise, the lowest core loss at 17 KG for the nominal 7.5 mils samples was 0.708 WPP when cold rolled 71%, which is higher than for Heat 602. Although these absolute values of the percent cold reduction vary for the two Heats, the data demonstrate that production of good core loss at 17 KG requires increased percent final cold deformation as the final gauge decreases.

Those skilled in the art will recognize that differences in processing and/or compositional changes will exist between several pieces of silicon steel so that even "identical" processing may not yield exactly identical results.

To further illustrate several aspects of the present invention, various samples of a silicon steel having a composition similar to the above-described typical composition were processed and the results of the tests are shown in the following Table II.

TABLE II

| | HRB Gauge | Intermediate Gauge | Avg. Final Gauge | Avg. % Final Cold Red. | Core Loss (WPP) at 13 KG (1.3 T) | 15 KG (1.5 T) | 17 KG (1.7 T) | Permeability at 10 H | 200 B |
|---|---|---|---|---|---|---|---|---|---|
| Sample Avg. | | | | | | | | | |
| A | 0.08 | .022 | .0067 | 70 | .310 | .447 | .736 | 1792 | .0174 |
| B | 0.08 | .022 | .0075 | 65.9 | .298 | .417 | .645 | 1846 | .0149 |
| C | 0.08 | .020 | .0068 | 66 | .296 | .423 | .682 | 1822 | .0162 |
| D | 0.075 | .0177 | .0069 | 60.4 | .307 | .437 | .701 | 1823 | .0172 |
| Comparison 3-Stage Sample | | | | | | | | | |
| E | 0.080 | — | .0069 | — | .298 | .423 | .683 | 1821 | .0169 |
| F | 0.080 | — | .0077 | — | .316 | .444 | .709 | 1827 | .0183 |

The magnetic properties listed in Table II represent an average value for core loss and permeability for various numbers of samples for each group. The properties are comparable to or better than magnetic properties obtained using a conventional three-stage cold reduction process for producing 7-mil or 7.5-mil silicon-iron sheet. As shown in Table II, conventionally-produced three-stage processed material has a core loss of 0.298, 0.423 and 0.683WPP at 13, 15 and 17 kilogauss, respectively, for 7-mil material, while having a permeability at 10 oersteds of 1821. For 7.5-mil material, conventionally three-stage cold reduced material has a core loss of 0.316, 0.444 and 0.709 WPP at 13, 15 and 17 KG, respectively, and a permeability at 10 H of 1827.

An advantage of the method of the present invention is that comparable or better magnetic material in thinner gauge can be produced in a more economical way. Furthermore, the data demonstrate that excellent quality can be produced with a two-stage cold reduction process using the percent final reduction within the range specified. Although preferred and alternative embodiments have been described, it will be apparent to one skilled in the art that changes can be made therein without departing from the scope of the invention.

What is claimed is:

1. A method for producing thin guage cube-on-edge grain-oriented silicon steel from hot-rolled band to fianl guage in two cold reduction steps, the method comprising:

cold working the hot-rolled band to an intermediate guage steel by a reduction of at least 72%;

annealing the intermediate guage to effect primary recrystallized grain structure;

cold working the intermediate annealed gauge steel to a final guage of 0.0065 to 0.0085 inch by a cold reduction of between 55 and 76%;

then applying to the final guage steel a refractory coating; and final texture annealing for time and temperature sufficient to develop secondary recrystallization.

2. The method as set forth in claim 1 wherein the hot-rolled band is of a guage ranging from 0.06 to 0.10 inch.

3. The method as set forth in claim 1 wherein the cold-worked intermediate gauge ranges from 0.019 to 0.022 inch.

4. The method as set forth in claim 1 wherein the final gauge is 0.0065 to 0.0075 inch.

5. A method for producing thin gauge cube-on-edge grain-oriented silicon steel from hot-rolled band to final gauge in two cold reduction steps, said steel being a mananese-sulfide-inhibited steel containing 2.5 to 4%, by weight, silicon, the method comprising:

cold rolling the hot-rolled band of about 0.06 to 0.10 inch to an intermediate guage of from 0.019 to 0.022 inch by a reduction of at least 72%;

annealing the intermediate guage steel at temperatures of 1700° to 1750° F. in a nonxidizing atmosphere;

cold rolling the annealed intermediate guage steel to final gauge of 0.0065 to 0.0075 inch by a cold reduction of between 55 and 72%;

annealing the steel to effect decarburization;

then applying to the steel a refractory coating; and final texture annealing the final gauge steel for time and temperature to develop secondary recrystallization.

6. The method as set forth in claim 5 wherein the hot-rolled band of nominally 0.080 inch is cold rolled to an intermediate guage of nominally 0.020 inch, and the annealed intermediate guage is cold rolled by a reduction of about 65% to a final guage of nominally 0.007 inch.

* * * * *